US006186374B1

(12) United States Patent
Gross

(10) Patent No.: US 6,186,374 B1
(45) Date of Patent: Feb. 13, 2001

(54) DISPENSING STRUCTURE WHICH HAS A LID WITH A PUSH-IN MOUNTED PRESSURE-OPENABLE VALVE

(75) Inventor: Richard A. Gross, Oconomowoc, WI (US)

(73) Assignee: Seaquist Closures Foreign, Inc., Crystal Lake, IL (US)

( * ) Notice: Under 35 U.S.C. 154(b), the term of this patent shall be extended for 0 days.

(21) Appl. No.: 09/432,135

(22) Filed: Nov. 2, 1999

(51) Int. Cl.[7] ..... B65D 25/40
(52) U.S. Cl. ..... 222/494
(58) Field of Search ..... 222/494, 491, 222/556

(56) References Cited

U.S. PATENT DOCUMENTS 4,728,006 * 3/1988 Drobish et al. ..... 222/181
5,390,805 * 2/1995 Bilani et al. ..... 215/260
5,642,824 * 7/1997 Hess, III et al. ..... 215/235
6,006,960 * 12/1999 Gross ..... 222/494
6,089,419 * 7/2000 Gross ..... 222/494

* cited by examiner

*Primary Examiner*—Kevin Shaver
*Assistant Examiner*—Melvin A. Cartagena
(74) *Attorney, Agent, or Firm*—Rockey, Milnamow & Katz, Ltd.

(57) ABSTRACT

A dispensing structure is provided for discharging the contents from the interior of a container. The structure includes a body for extending from the container. The body defines a dispensing opening and a sealing surface around the dispensing opening. A lid is provided for movement between open and closed positions. The lid has a frame defining a lid dispensing passage through the lid. The lid has a mounting flange extending inwardly adjacent the dispensing passage, and the lid has a valve mounted to the lid flange across the dispensing passage. The flexible valve has self-sealing slits which open to permit flow therethrough in response to increased pressure on the side of the valve facing the container when the lid is closed. The valve has a lower flange which is below the lid flange and which sealingly engages the body sealing surface when the lid is in the closed position.

19 Claims, 3 Drawing Sheets

DISPENSING STRUCTURE WHICH HAS A LID WITH A PUSH-IN MOUNTED PRESSURE-OPENABLE VALVE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a product from a container. This invention is more particularly related to a system incorporating a dispensing valve which is especially suitable for use with a container from which a substance can be discharged from the container through the valve when the interior container pressure is increased.

BACKGROUND OF THE INVENTION AND TECHNICAL PROBLEMS POSED BY THE PRIOR ART

A variety of packages, including dispensing packages or containers, have been developed for personal care products such as shampoo, lotion, etc., as well as for other materials. Such containers typically have a neck defining an open upper end on which is mounted a dispensing closure.

One type of dispensing closure for these kinds of containers has a flexible, pressure-openable, self-sealing, slit-type dispensing valve mounted in the closure over the container opening. When the container is squeezed, the valve slits open, and the fluid contents of the container are discharged through the open slits of the valve. The valve automatically closes to shut off fluid flow therethrough upon removal of the increased pressure—even if the container is inverted so that the valve is subjected to the weight of the contents within the container.

Designs of closures using such valves are illustrated in the U.S. Pat. Nos. 5,271,531 and 5,033,655. Typically, the closure includes a body mounted on the container neck to hold the valve over the container opening.

A lid can be provided for covering the valve during shipping and when the container is otherwise not in use. See, for example, FIGS. 31–34 of U.S. Pat. No. 5,271,531. Such a lid can be designed to prevent leakage from the valve under certain conditions. The lid can also keep dust and dirt from the valve and/or can protect the valve from damage.

The inventor of the present invention has determined that it would be advantageous to provide an improved dispensing structure that has a lid and a flexible, slit valve and that can have multiple modes of operation on a container. It would be particularly beneficial to provide such a dispensing structure with the capability in a first operational mode for accommodating the removal of product from the container with a spoon or by pouring. It would be beneficial to provide a second mode of operation for accommodating the squirting of a stream of product through the valve.

It would also be desirable to provide such an improved dispensing structure for covering the product in the container while at the same time accommodating venting of gases through the valve. This would permit, for example, microwave heating of a food product in the container because steam or other gases driven off in the heating process could readily escape through the valve.

Such an improved dispensing structure should also accommodate designs which permit incorporation of the dispensing structure as a unitary part, or extension, of the container and which also accommodate designs that separately mount the dispensing structure on the container in a secure manner.

It would also be beneficial if such an improved dispensing structure could readily accommodate its manufacture from a variety of different materials.

Further, it would be desirable if such an improved dispensing structure could be provided with a design that would accommodate efficient, high-quality, large volume manufacturing techniques with a reduced product reject rate.

Preferably, the improved dispensing structure should also accommodate high-speed manufacturing techniques that produce products having consistent operating characteristics unit-to-unit with high reliability.

The present invention provides an improved dispensing structure which can accommodate designs having the above-discussed benefits and features.

SUMMARY OF THE INVENTION

According to one aspect of the present invention, a dispensing structure is provided for discharging the contents from the interior of a container. The dispensing structure includes a body for extending from the container. The body defines a dispensing opening for establishing communication between the exterior and interior of the container. The body has a sealing surface around the body dispensing opening.

The dispensing structure includes a lid for accommodating movement between (1) a closed position over the body dispensing opening, and (2) an open position away from the body closed position. The lid comprises a frame defining a lid dispensing passage through the lid and a flexible valve that is disposed within the lid frame across the lid dispensing passage. The valve has self-sealing slits which open to permit flow therethrough in response to increased pressure on the side of the valve facing the container when the lid is closed. When the lid is closed, the container can be squeezed to dispense a flowable product out of the container through the valve. Also, when the lid is closed, the container can be heated, as in a microwave oven, and any gases generated during the heating can escape by venting through the valve. When the lid is closed, a peripheral part of the valve seals against the body sealing surface, and the body sealing surface helps hold the valve in the closed lid when product is dispensed through the valve in the closed lid.

If it is desired to remove product from the container with a spoon, the lid, with the valve held therein, can be moved to the open position. A spoon can then be inserted into the container. Alternatively, with the lid in the open position, the container can be inverted, and the product can be poured out of the container.

Numerous other advantages and features of the present invention will become readily apparent from the following detailed description of the invention, from the claims, and from the accompanying drawing.

BRIEF DESCRIPTION OF THE DRAWINGS

In the accompanying drawings that form part of the specification, and in which like numerals are employed to designate like parts throughout the same.

FIG. 4 shows the closure in the closed condition with a releasable label or cover placed on the top of the closed lid;

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the dispensing structure of this invention is described in various operating positions. It will be understood, however, that the dispensing structure of this invention may be manufactured, stored, transported, used, and sold in orientations other than the positions described.

Figure 1:
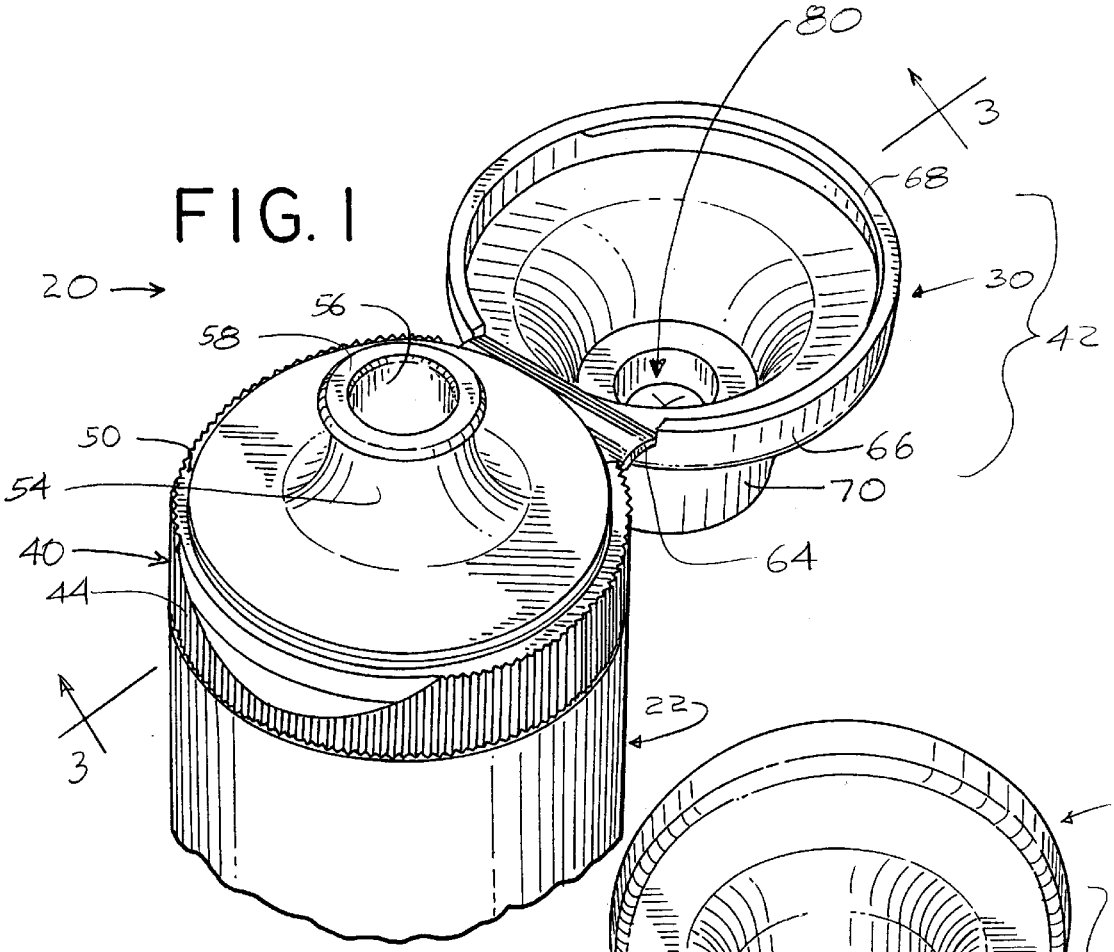
FIG. 1 is a fragmentary, perspective view of a first embodiment of the dispensing structure of the present invention which comprises a separate closure that is mounted on a container and that has an attached lid shown in an open position.

One presently preferred embodiment of the dispensing structure of the present invention is illustrated in FIGS. 1–8 in the form of a dispensing closure designated generally in many of the figures by the reference number 20. The dispensing structure or closure 20 is provided as a separately manufactured unit for mounting to the top of a container 22 (FIG. 1). It will be appreciated, however, that it is contemplated that in some applications it may be desirable for the dispensing structure 20 to be formed as a unitary part, or extension, of the container 22.

The container 22 typically has a conventional mouth 24 (FIG. 4) which provides access to the container interior and product contained therein. The product may be, for example, a liquid comestible product. The product could also be any other solid, liquid, or gaseous material, including, but not limited to, a food product, a personal care product, an industrial or household cleaning product, a paint product, a wall patch product, or other composition (e.g., for use in activities involving manufacturing, commercial or household maintenance, construction, remodeling, agriculture, etc.).

Figure 4:
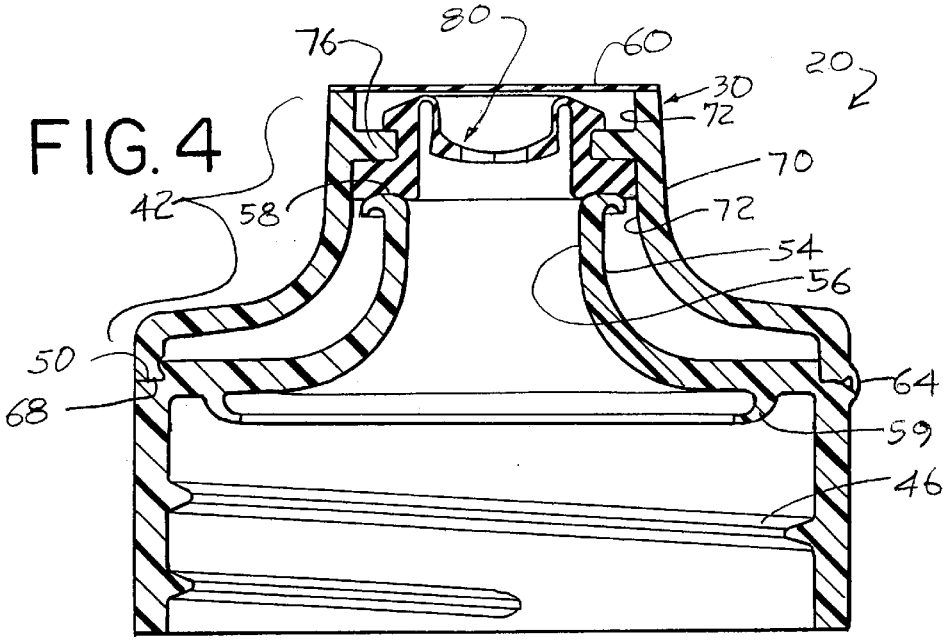
FIG. 4 is a greatly enlarged view similar to FIG. 3, but in FIG. 4 the container has been omitted.

The container 22 may typically have a neck or other suitable structure defining the container mouth 24 (FIG. 4). The neck may have (but need not have) a circular cross-sectional configuration, and the body of the container 22 may have another cross-sectional configuration, such as an oval cross-sectional shape, for example. The container 22 may, on the other hand, have a substantially constant shape along its entire length or height without any neck portion of reduced size or different cross-section.

The container 22 may typically be a squeezable container having a flexible wall or walls which can be grasped by the user and compressed to increase the internal pressure within the container 22 so as to squeeze the product out of the container 22 through the closure 20 when the closure 20 is open. Such a container wall typically has sufficient, inherent resiliency so that when the squeezing forces are removed, the container wall returns to its normal, unstressed shape. Such a structure is preferred in many applications, but may not be necessary or preferred in other applications. Indeed, the container 22 may be substantially rigid. A piston could be provided in such a rigid container to aid in dispensing a product, especially a relatively viscous product.

The dispensing structure or closure 20 includes a base or body 40 and a lid 30 comprising (1) a frame 42, and (2) a flexible, pressure-openable, slit-type valve 80 mounted in the lid frame.

Figure 2:
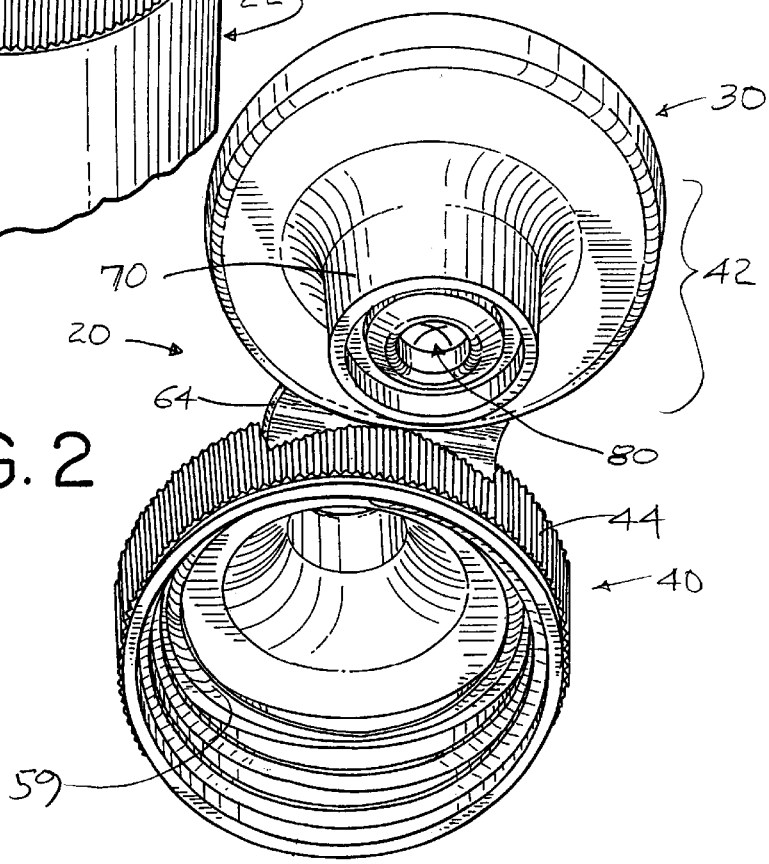
FIG. 2 is a perspective view of the bottom of the first embodiment of the closure in an open position shown removed from the container.

The closure body 40 defines a skirt 44 (FIG. 4) which has a conventional thread 46 as shown in FIG. 2 for engaging a thread 48 on the neck of the container 22 (FIG. 4) to secure the closure body 40 to the neck of the container 22.

The closure body 40 and container 22 could also be releasably connected with a snap-fit bead and groove, or by other means. Alternatively, the closure body 40 may be permanently attached to the container 22 by means of induction melting, ultrasonic melting, gluing, or the like, depending upon the materials employed for the container and closure. Further, the closure 20 could, in some applications, be formed as a unitary part, or extension, of the container 22.

Figure 3:
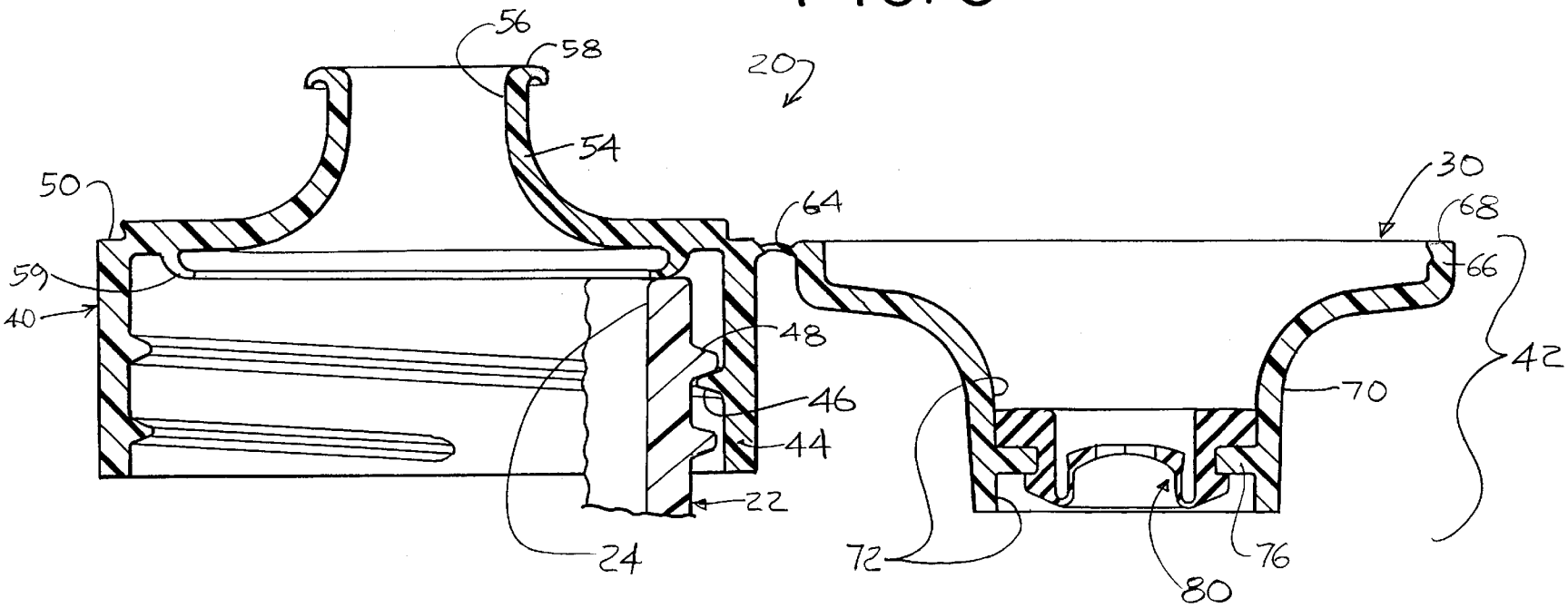
FIG. 3 is a cross-sectional view of the closure taken generally along the plane 3—3 in FIG. 1 and showing a portion of the container.

At the top of the closure skirt 44, the closure body 40 defines a radially inwardly extending, annular shoulder 50 (FIGS. 1 and 3). Projecting outwardly (i.e., upwardly in FIGS. 3 and 4) from the closure body shoulder 50 is a spout 54 having an annular housing portion with an open distal end which can be closed by the lid 30. The spout 54 defines an internal dispensing opening 56 (FIG. 1) for establishing communication between the exterior and interior of the container 22. At least part of the opening 56 is defined or circumscribed by a generally annular sealing surface 58 (FIG. 3) at the top of the annular housing portion or spout 54.

Preferably, as can be seen in FIG. 3, an annular, flexible "crab's claw" shaped seal 59 projects from the lower portion of the closure body spout 54 adjacent the upper end of the container neck so as to provide a leak-tight seal between the closure body 40 and the container neck. Of course, other types of closure body/container seals may be employed.

The lid 30, when closed, functions as a cover which can still permit the product to be dispensed from the container through the lid 30. Further, a label or other releasable seal member or cover, such as label 60 (FIG. 4), can be secured over the top of the closed lid 30 so that the closed lid 30 can also function as a substantially leak-tight lid to prevent air ingress and/or discharge of the product from the container when the container is subjected to intentional or inadvertent impact that may temporarily increase the pressure within the container. The lid 30, with such a releasable label 60 secured thereto, will prevent discharge from the container during shipping of the container, during warehousing, and while the container is on display in a store, or while a container is initially being stored by a user.

The lid 30 is preferably hingedly connected to the closure body 40 with a snap-action hinge 64 (FIG. 1). Such a hinge is disclosed in the U.S. Pat. No. 5,642,824, the disclosure of which is incorporated herein by reference thereto. In an alternate embodiment, the lid need not be connected with a snap-action hinge. A floppy hinge may be used instead. Further, in another embodiment (not illustrated), no hinge at all need be employed. The lid 30 could be completely separate, and completely removable, from the closure body 40.

The lid 30 includes a sidewall or skirt 66 (FIG. 3) from which the hinge 64 extends to the body 40. The bottom edge of the lid skirt 66 defines a seating surface 68 (FIGS. 1 and 4). When the lid 30 is closed, the seating surface 68 engages the annular shoulder 50 defined on the closure body 40 at the top of the closure body skirt 44.

The lid 30 includes a spout 70 projecting up from the skirt 66, and the spout 70 defines a central dispensing passage 72 (FIG. 4). When the lid 30 is closed, the dispensing passage 72 is generally in alignment with, and concentric with, the closure body dispensing opening 56. On the inside of the lid spout 70 near the top of the spout dispensing passage 72 there is an annular mounting flange 76 which extends radially inwardly from the inside surface of the spout 70.

Figure 7:
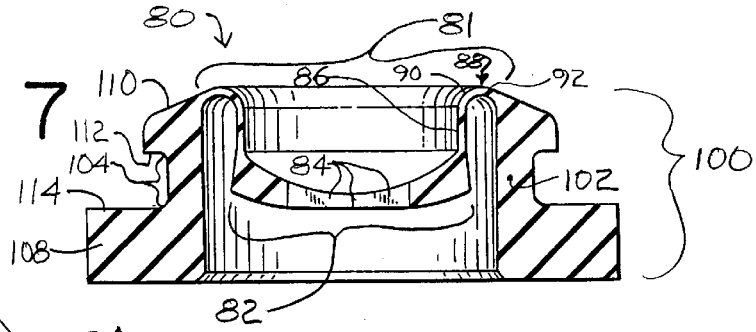
FIG. 7 is a side elevational view of the valve shown in FIG. 5.
Figure 6:
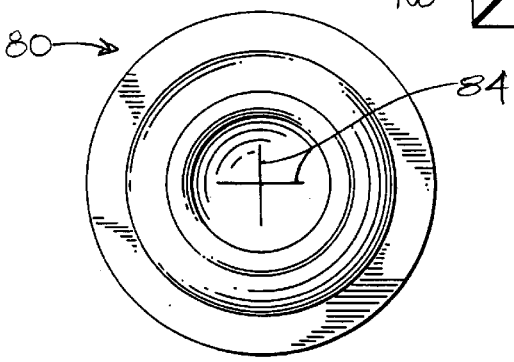
FIG. 6 is a top plan view of the valve shown in FIG. 5.
Figure 5:
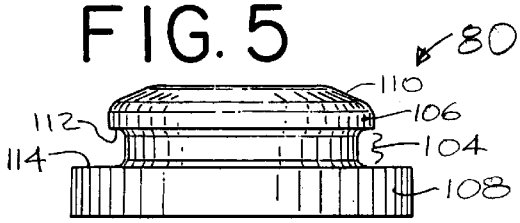
FIG. 5 is a side elevational view of the valve employed in the dispensing closure shown in FIGS. 1–4.

The preferred form of the valve 80 is illustrated FIGS. 5–7. The valve 80 includes "head" and "connecting sleeve" portions of a known design described hereinafter employing a flexible, resilient material, and the valve 80 can open to dispense product as described in detail hereinafter. The valve 80 may be molded from thermosetting elastomeric materials, such as natural rubber and the like. The valve 80 is preferably manufactured from silicone rubber sold by Dow Chemical Company in the United States of America under the trade designation DC-595. However, the valve 80 can also be molded from thermoplastic elastomers based upon materials such as thermoplastic propylene, ethylene, urethane, and styrene, including their halogenated counterparts.

The valve 80, when molded from these materials, is flexible, pliable, elastic, and resilient so that a marginal portion thereof can be temporarily and elastically deformed as it is mounted to, and sealingly engaged with, the spout mounting flange 76.

As shown in FIG. 7, the valve 80 includes a centrally disposed active portion 81. The valve active portion 81, in the preferred embodiment illustrated, has the configuration and operating characteristics of a commercially available valve design substantially as disclosed in the U.S. Pat. No. 5,409,144 with reference to the valve 3d disclosed in the U.S. Pat. No. 5,409,144. The operation of such a commercially available valve is described with reference to the valve that is designated by reference number 3d in the U.S. Pat. No. 5,409,144. The description of the valve in that patent is incorporated herein by reference thereto to the extent pertinent and to the extent not inconsistent herewith.

As illustrated in FIG. 7 herein, the valve active portion 81 includes a flexible, central, head portion or central wall 82 which has an outwardly concave configuration and which defines at least two, intersecting, dispensing slits 84 extending through the head portion or central wall 82 to define a normally closed, dispensing orifice. A preferred form of the valve 80 has two, mutually perpendicular, intersecting slits 84 of equal length. In the valve concave, central wall 82, the intersecting slits 84 define four, generally sector-shaped, flaps or petals 85 (two of which are visible in FIG. 8). The flaps 85 open outwardly from the interfaces of the slits 84 in response to increasing pressure of sufficient magnitude in the well-known manner described in the above-discussed U.S. Pat. No. 5,409,144.

The valve 80 can be molded with the slits 84. Alternatively, the valve slits 84 could be subsequently cut into the face or head 82 of the valve 80 by suitable conventional techniques.

The active portion 81 of the valve 80 also includes a connector sleeve or skirt 86 (FIG. 7) which extends outwardly from the valve head portion or central wall 82. The outer (upper) end of the connector sleeve 86 includes a thin, annular flange 88 (FIG. 7) which extends peripherally to define an upwardly curved portion 90 and a downwardly angled portion 92. The thin flange 88 terminates in an enlarged, much thicker, peripheral marginal portion 100.

The marginal portion 100 is connected with the valve head portion 82 through the connector sleeve 86 and has a generally annular wall 102 defining a generally annular groove 104 (FIG. 7) which is open radially outwardly for receiving the lid mounting flange 76. The annular wall 102 is sufficiently flexible to temporarily deform as the wall 102 is forced against the mounting flange 76 to accommodate seating of the mounting flange 76 in the groove 104. The annular wall 102 is also sufficiently resilient to accommodate the retention of the mounting flange 76 in the groove 104 by adjacent portions of the wall 102.

The generally annular wall 102 includes a generally annular, upper shoulder 106 and a generally annular, lower, retention flange 108. The groove 104 is located below the shoulder 106 and above the retention flange 108. The upper shoulder 106 defines a generally frustoconical lead-in surface 110 (FIG. 7) facing generally away from the retention flange 108. The upper shoulder 106 also defines a generally annular undercut surface 112 which faces generally toward the retention flange 108 and which defines one side of the groove 104. The retention flange 108 has a generally flat, annular, upper surface 114 defining one side of the groove 104 and facing toward the undercut surface 112. In the preferred embodiment illustrated in FIG. 4, the retention flange 108 extends radially outwardly beyond the radial extent of the upper shoulder 106.

The valve 80 can be readily assembled with the closure body 40 by forcing the valve 80 into the lid 30 from the underside or interior side of the lid spout 70. The valve frustoconical lead-in surface 110 engages the bottom, inner peripheral edge of the mounting flange 76. The frustoconical lead-in surface 110 tends to provide a self-centering action for the valve 80 as it is forced upwardly against the flange 76. The valve 80 deforms, by being sufficiently compressed generally radially inwardly, to permit the upper shoulder 106 to move past the mounting flange 76 so that the valve 80 snaps into a tight engagement wherein the mounting flange 76 is received in the groove 104 of the valve 80. Preferably, the height of the groove 104 is slightly less than the thickness of the mounting flange 76 so as to provide a tight sealing engagement between the valve 80 and the mounting flange 76.

In the preferred embodiment, the groove 104 is defined at a location along the annular wall 102 which locates the sleeve 86 and head portion 82 within the dispensing passage 72. That is, the sleeve 86 and head portion 82 are located inwardly of the outer end of the lid dispensing passage 72 so that the valve 80 does not project outwardly beyond the dispensing passage 72 when the valve head portion slits 84 are closed while the valve 80 is mounted to the flange 76 and sealingly disposed with respect to the discharge opening 72.

Preferably, the lower retention flange 108 has a height (e.g., along the vertical axis of the valve 80) which exceeds the height of the groove 104. This provides a relatively substantial anchor function or retention finction and better resists forces that might tend to separate the valve 80 from the annular flange 76.

The above-described mounting structure of the dispensing system of the present invention can be readily assembled in a manner which does not require a separate snap-fit clamping member or a separate retainer collar for threaded attachment which could impose undesirable stresses and/or undesirable torque on the valve 80, which stresses and torque could deleteriously affect the operation of the valve.

The structure of the dispensing system of the present invention simplifies the equipment required for assembly, and the process of assembling the system is less costly. The dispensing system can incorporate a valve 80 of various diameters, slit sizes, and head configurations.

When the valve 80 is properly mounted within the lid 30, and when the lid 30 is closed (FIG. 4), the bottom surface of the valve flange 108 engages the closure body spout annular sealing surface 58 which seals against the flange 108. The sealing engagement also helps retain the valve 80 within the closed lid 30 when the contents of the container 22 are dispensed through the valve 80 by squeezing the container 22 as described in detail hereinafter. Typically, as the container 22 is squeezed to discharge product through the valve 80, the valve 80 is subjected to outwardly acting forces which tend to push on the valve 80 in the outward direction. However, because the valve flange 108 is squeezed and clamped between the closure body spout sealing surface 58 and the lid flange 76, the outwardly directed forces acting on the valve 80 are resisted by the clamping action, as well as by the engagement of the lid flange 76 by the valve 80 shoulder 106 and flange 108.

When the valve 80 is properly mounted within the closure lid 30 as illustrated in FIG. 4, the central face or head 82 of the valve 80 lies recessed within the closure lid 30. However, when the container 22 (FIG. 1) is squeezed to dispense the contents through the valve 80, then the valve central face or head 82 is forced outwardly from its recessed position toward the end of the lid 30 (FIG. 8) as described in more detail hereinafter.

When the closure 20 is manufactured and initially assembled on the container 22, the closure 20 is typically initially arranged in the closed condition (FIG. 4). This is also the condition in which the package comprising the container 22 and closure 20 can be conveniently carried in a user's suitcase while the user is traveling.

In some applications, it may be desirable to provide the releasable label or cover 96 (FIG. 4) on the lid 30 over the valve 80. In order to use the closure 20 to dispense product or other fluid through the valve 80, such a label or cover 96 (FIG. 4) must first be removed by the user.

Figure 8:
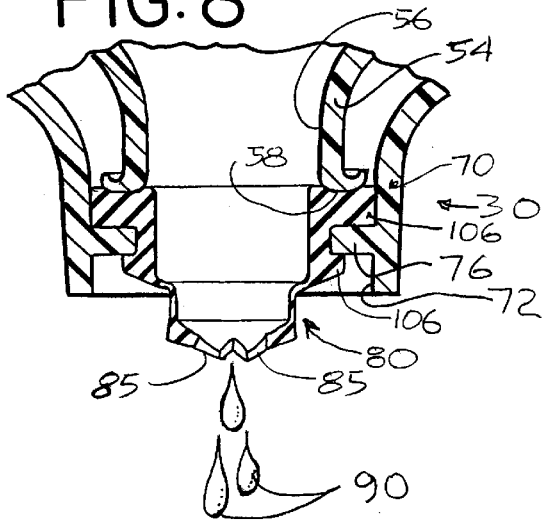
FIG. 8 is a greatly enlarged, fragmentary view similar to FIG. 4, but FIG. 8 shows the release cover or label removed from the top of the lid and shows the closure inverted in a dispensing mode.

In use, the container 22 is typically inverted and squeezed to increase the pressure within the container 22 above the ambient exterior atmospheric pressure. This forces the product within the container toward the valve 80 and forces the valve 80 from the recessed or retracted position (illustrated in FIG. 4) toward the outwardly extending position (FIG. 8). The outward displacement of the central face or head 82 of the valve 80 is accommodated by the relatively, thin, flexible, skirt 86. The skirt 86 moves from an inwardly projecting, rest position to an outwardly displaced, pressurized position, and this occurs by the skirt 86 "rolling" along itself outwardly toward the outside of the lid 30 (toward the position shown in FIG. 8). However, the valve 80 does not open (i.e., the slits 84 do not open) until the valve central face 82 has moved substantially all the way to a fully extended position beyond the dispensing passage 72. Indeed, as the valve central wall or head 82 begins to move outwardly, the valve central wall or head 82 is initially subjected to radially inwardly directed compression forces which tend to further resist opening of the slits 84. Also, the valve central wall or head 82 generally retains its inwardly concave configuration as it moves outwardly and even after it reaches the fully extended position. However, when the internal pressure becomes sufficiently high after the valve central wall or head 82 has moved outwardly to the fully extended position, then the slits 84 of the valve 80 begin to open to dispense product (FIG. 8 ). The product is then expelled or discharged through the open slits 84. For illustrative purposes, FIG. 8 shows drops 90 of a liquid product being discharged.

It will be appreciated that the product can be dispensed through the valve 80 when the lid 30 is in the closed orientation as shown in FIG. 8. However, in some applications, it may be desirable to also permit vapor or other gases to be vented through the valve 80 when heating the container 22 with the lid 30 closed (and the label or cover 96 is removed or never installed in the first place). In such applications, it may be preferable to also provide a protective baffle (not illustrated) spaced outwardly of the lid dispensing passage 72.

Whether or not a baffle is employed, the container may be placed in a microwave oven, and the product within the container can be heated with the microwave energy. As gas or vapor is generated by the heating process, pressure will increase within the container. Eventually, the pressure becomes sufficiently high that the valve 80 is forced to the open configuration to permit the escape or venting of the vapor or gas. The use of the valve 80 with the small slits permits venting of the vapor or gas while still providing a sufficient cover over the product within the container so as to prevent significant splashing of the liquid product out of the container if the product boils or spurts within the container. Subsequently, after the completion of microwave heating, the product can be dispensed from the container through the valve 80 in the manner previously described with reference to FIG. 8.

The use of the closure 20 with the valve 80 for venting hot gases is advantageous compared with conventional microwaveable packages which require a portion of the package to first be opened by the user in order to establish a vent passage. The closure of the present invention is not only more convenient, but is also safer, especially in the hands of children.

It will also be appreciated that the closure 20 of the present invention may be used to permit the venting of gases that build up from a product within the container even when the container is not subjected to microwave energy. For example, over a period time, some products can undergo a chemical reaction which may generate gases within the container and/or gas pressure may build up within a container owing to high ambient temperatures or reduction in ambient pressures (e.g., airline transport). The valve 80 in the closure of the present invention will permit such gases to vent to ambient atmosphere (if the label or cover 96 is removed (or not installed in the first place)). This can prevent bulging of the container.

It will also be appreciated that the lid 30 can be moved to the fully opened position (FIG. 1) to permit access to the container interior. This provides another mode of operation. Specifically, the product within the container can then be poured out of the container through the closure body dispensing opening 56. Alternatively, a spoon, or other instrumentality, can be inserted into the container 22 through the dispensing opening 56 for removing some of the product.

In some applications, it may be desirable to provide a foil membrane or a liner (not illustrated) across the bottom surface of the closure body spout 54 to occlude the body dispensing opening 56. The liner could alternatively be sealed to the container 22 over the top of the container opening 24. In either case, the liner would first have to be broken or removed to provide communication with the container interior.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing structure for discharging the contents from the interior of a container, said dispensing structure comprising:

a body for extending from said container, said body defining a dispensing opening for establishing communication between the exterior and interior of said container, and said body having a sealing surface around said body dispensing opening; and a lid having a frame defining a lid dispensing passage through said lid, said lid frame including an annular mounting flange extending radially inwardly adjacent said lid dispensing passage, said lid including a flexible valve that is disposed within said lid frame across said lid dispensing passage to resiliently engage said lid mounting flange, said valve having self-sealing slits which open to permit flow therethrough in response to increased pressure on the side of said valve facing said container when said lid is closed, said lid accommodating movement between (1) a closed position over said body dispensing opening whereby the container contents can be dispensed through said body dispensing opening, through said lid dispensing passage, and through said valve, and (2) an open position away from said dispensing opening to accommodate pouring of the contents from the container through said dispensing opening without flowing through said valve, said lid when in said closed position being in sealing relationship with said body sealing surface, said valve having a retention flange with one side engaging said lid mounting flange and with another side engaging said body sealing surface when said lid is in said closed position.

2. The dispensing structure in accordance with claim 1 in which said body is formed separately from said container; and said body has a skirt with an internal thread for threadingly engaging an external thread on said container to permit said body to be removably mounted to said container.

3. The dispensing structure in accordance with claim 1 in which said body is a unitary part of said container.

4. The dispensing structure in accordance with claim 1 in which said lid is hingedly connected to said body.

5. The dispensing structure in accordance with claim 1 in which said body includes a spout; and said body sealing surface is defined at an upper end of said spout as an annular configuration around said body dispensing opening.

6. The dispensing structure in accordance with claim 1 in which said lid includes a releasable cover adhesively secured to said lid frame over said lid dispensing passage.

7. The dispensing structure in accordance with claim 1 in which said body includes a liner below, and occluding, said dispensing opening.

8. The dispensing structure in accordance with claim 1 in which said dispensing structure is defined by a closure which is separate from, but releasably attachable to, said container;

said body defines a body of said closure; and said lid defines a lid of said closure.

9. A dispensing structure for discharging the contents from the interior of a container, said dispensing structure comprising:

a body for extending from said container, said body defining a dispensing opening for establishing communication between the exterior and interior of said container, and said body having a sealing surface around said body dispensing opening; and a lid for accommodating movement between (1) a closed position over said body dispensing opening, and (2) an open position away from said closed position, said lid having a frame defining a lid dispensing passage through said lid, said lid frame having an annular mounting flange extending radially inwardly adjacent said lid dispensing passage, said lid including a flexible valve that is disposed within said lid frame across said lid dispensing passage and that has self-sealing slits which open to permit flow therethrough in response to increased pressure on the side of said valve facing said container when said lid is closed, said valve having a generally annular wall defining a generally annular groove which is open radially outwardly for receiving said lid mounting flange, said wall being (1) sufficiently flexible to temporarily deform as said wall is forced against said lid mounting flange to accommodate seating of said lid mounting flange in said groove, and (2) sufficiently resilient to accommodate the retention of said lid mounting flange in said groove by adjacent portions of said valve annular wall, said valve annular wall including a retention flange with one side engaging said lid mounting flange and with another side engaging said body sealing surface when said lid is in said closed position.

10. The dispensing structure in accordance with claim 9 in which said valve has a head portion in which said slits are defined and has a sleeve extending from said head portion to accommodate outward movement of said head portion in response to increased pressure on the side of said valve facing said container when said lid is closed; and said groove is defined at a location along said annular wall to locate said sleeve and head portion within said dispensing passage of said lid when said valve slits are closed.

11. The dispensing structure in accordance with claim 9 in which said lid is hingedly connected to said body.

12. The dispensing structure in accordance with claim 9 in which said dispensing structure is defined by a closure which is separate from, but releasably attachable to, said container;

said body defines a body of said closure; and said lid defines a lid of said closure.

13. The dispensing structure in accordance with claim 9 in which said body is a unitary part of said container.

14. The dispensing structure in accordance with claim 9 in which said valve retention flange has a height which exceeds the height of said groove.

15. The dispensing structure in accordance with claim 9 in which said valve annular wall includes a generally annular upper shoulder spaced above said valve retention flange; and said groove is located below said upper shoulder and above said valve retention flange.

16. The dispensing structure in accordance with claim 15 in which said upper shoulder defines (1) a generally frusto-conical lead-in surface facing generally away from said retention flange, and (2) a generally annular undercut surface which faces generally toward said retention flange and which defines one side of said groove.

17. The dispensing structure in accordance with claim 16 in which said retention flange has a generally flat, annular, upper surface defining one side of said groove and facing toward said undercut surface of said shoulder.

18. The dispensing structure in accordance with claim 15 in which said retention flange extends radially outwardly beyond the radial extent of said upper shoulder.

19. The dispensing structure in accordance with claim 9 in which said valve is molded from just one material; and said one material is one of a thermoplastic elastomer and a thermosetting polymer.

* * * * *